US008690080B2

(12) United States Patent
Myers et al.

(10) Patent No.: US 8,690,080 B2
(45) Date of Patent: Apr. 8, 2014

(54) COMPACT HIGH FLOW PRESSURE ATOMIZERS

(75) Inventors: Steve Jay Myers, Norwalk, IA (US); Robert Russell Fogarty, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 362 days.

(21) Appl. No.: 13/239,104

(22) Filed: Sep. 21, 2011

(65) Prior Publication Data

US 2013/0068856 A1 Mar. 21, 2013

(51) Int. Cl.
*B05B 1/34* (2006.01)

(52) U.S. Cl.
USPC ..... 239/463; 239/483

(58) Field of Classification Search
USPC ..... 239/463, 461, 589, 483, 468, 472
See application file for complete search history.

(56) References Cited

U.S. PATENT DOCUMENTS

| | | | | |
|---|---|---|---|---|
| 3,680,793 | A | 8/1972 | Tate et al. | |
| 5,915,352 | A * | 6/1999 | Okamoto et al. | 123/298 |
| 6,578,777 | B2 * | 6/2003 | Bui | 239/406 |
| 7,048,203 | B2 * | 5/2006 | Harada et al. | 239/36 |
| 2007/0001029 | A1 * | 1/2007 | Kjeldal et al. | 239/406 |

* cited by examiner

*Primary Examiner* — Davis Hwu
(74) *Attorney, Agent, or Firm* — Edwards Wildman Palmer LLP; Scott D. Wofsy; Joshua L. Jones

(57) ABSTRACT

A distributor for a pressure atomizer includes a distributor body having an upstream end defining an internal liquid circuit, a downstream end defining a spin chamber for swirling a liquid flowing therethrough, and an outboard peripheral surface extending from the upstream end to the downstream end. The upstream and downstream ends are spaced apart along a longitudinal axis. An inclined passage is defined in the outboard peripheral surface in fluid communication with the internal liquid circuit and with the spin chamber for producing a relatively wide spray angle for a given distributor body size. The inclined passage is angled to diverge from the longitudinal axis of the distributor body in a direction toward the downstream end.

18 Claims, 7 Drawing Sheets

COMPACT HIGH FLOW PRESSURE ATOMIZERS

BACKGROUND OF THE INVENTION

1. Field of the Invention

The present invention relates to injectors and nozzles for spaying liquids, and more particularly to pressure atomizers such as for use in fuel injectors of gas turbine engines.

2. Description of Related Art

A variety of devices are known for producing a spray from a pressurized liquid. Many of these are pressure atomizers designed to atomize fuel, water, or other liquids into a fine spray of droplets. Pressure atomizers can be made relatively small and therefore lend themselves to applications where space is limited. An exemplary pressure atomizer or nozzle is described in U.S. Pat. No. 3,680,793 to Tate et al.

In traditional configurations, the smaller a pressure atomizer nozzle is, the narrower its spray angle will be because of typical difficulties in achieving wide spray angles with small size pressure atomizers. In certain applications such as gas turbine engines, there can be a need for a wide spray angle but size constraints that require a small sized atomizer. In such situations, traditional atomizer designs create a need to compromise between nozzle size and maximum spray angle, which has heretofore limited design choices and therefore performance.

Such conventional methods and systems have generally been considered satisfactory for their intended purpose. However, there is still a need in the art for pressure atomizers that allow for improved spray angle and decreased size. There also remains a need in the art for such pressure atomizers that are easy to make and use. The present invention provides a solution for these problems.

SUMMARY OF THE INVENTION

The subject invention is directed to a new and useful distributor for a pressure atomizer. The distributor includes a distributor body having an upstream end defining an internal liquid circuit, a downstream end defining a spin chamber for swirling a liquid flowing therethrough, and an outboard peripheral surface extending from the upstream end to the downstream end. The upstream and downstream ends are spaced apart along a longitudinal axis. An inclined passage is defined in the outboard peripheral surface in fluid communication with the internal liquid circuit and with the spin chamber for producing a relatively wide spray angle for a given distributor body size. The inclined passage is angled to diverge from the longitudinal axis of the distributor body in a direction toward the downstream end.

In certain embodiments, the inclined passage is in fluid communication with the internal liquid circuit by way of a communication bore defined through the distributor body from the internal liquid circuit to an upstream portion of the inclined passage. The communication bore can extend in a substantially radial direction.

In another aspect, the inclined passage can be in fluid communication with the spin chamber by way of a swirl slot defined in the downstream end of the distributor body through an annular rim around the spin chamber. The swirl slot can include opposed slot walls in the annular rim, wherein the opposed slot walls define a flow path therethrough that is off-center with respect to the annular rim to induce swirl on fluids passing therethrough.

It is also contemplated that the outboard peripheral surface can be substantially cylindrical. The inclined passage can be ramped with respect to the outboard peripheral surface with a deeper portion thereof proximate the upstream end and a shallower portion thereof proximate the downstream end to accelerate fluids flowing therethrough from the upstream end to the downstream end of the distributor body.

In certain embodiments, the distributor body includes at least one additional inclined passage defined in the outboard peripheral surface in fluid communication with the internal liquid circuit and with the spin chamber. The inclined passages can be substantially evenly spaced apart from one another circumferentially. It is also contemplated that each inclined passage can be in fluid communication with the internal liquid circuit by way of a respective communication bore defined through the distributor body from the internal liquid circuit to an upstream portion of the inclined passage.

The invention also provides a pressure atomizer for producing an atomized spray of liquid. The pressure atomizer includes a distributor as described above and a spray tip in fluid communication with the spin chamber. The distributor and spray tip are configured and adapted to produce a spray of atomized liquid issuing from the spray tip with a relatively wide spray angle for a given distributor body size.

In certain embodiments, an air sleeve is included radially outboard of the spray tip for delivering a flow of air from an external source into proximity with the spray tip. A liquid delivery tube having a fluid delivery passage can be included in fluid communication with the internal liquid circuit of the distributor for delivering liquid thereto from an external source. A heat shield can be mounted outboard of the liquid delivery tube and inboard of the air sleeve for thermal isolation of liquid flowing through the liquid delivery tube from air flowing through the air sleeve. It is also contemplated that a flow passage can be defined between the inclined passage of the distributor and an inner surface of the spray tip that narrows toward the downstream end of the distributor to accelerate fluids passing therethrough.

The invention also provides a pressure atomizer for producing an atomized spray of liquid, wherein a spray tip is mounted outboard of a distributor. The distributor and spray tip are configured and adapted to produce a spray of atomized liquid issuing from the spray tip having a spray angle greater than about 90°, and wherein the outboard peripheral surface of the distributor has a diameter less than about 0.125 inches, and wherein the flow number is greater than about 6.0. In certain embodiments, a spray angle greater than about 80° can be attained with a flow number greater than about 4.0 wherein the diameter of the distributor is less than about 0.100 inches. It is also contemplated that, a spray angle greater than about 75° can be attained with a flow number greater than about 3.0 wherein the diameter of the distributor is less than about 0.080 inches.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
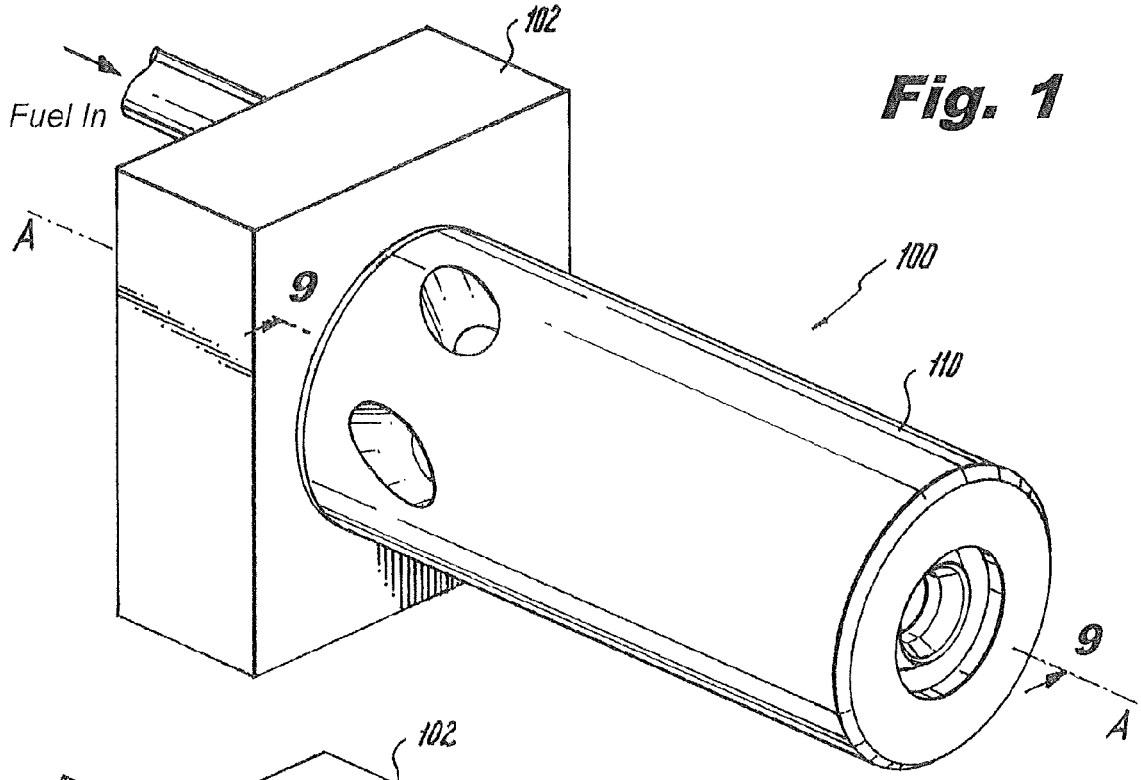
FIG. 1 is a perspective view of an exemplary embodiment of a pressure atomizer constructed in accordance with the present invention, showing the tip assembly of the pressure atomizer mounted to a manifold.
Figure 2:
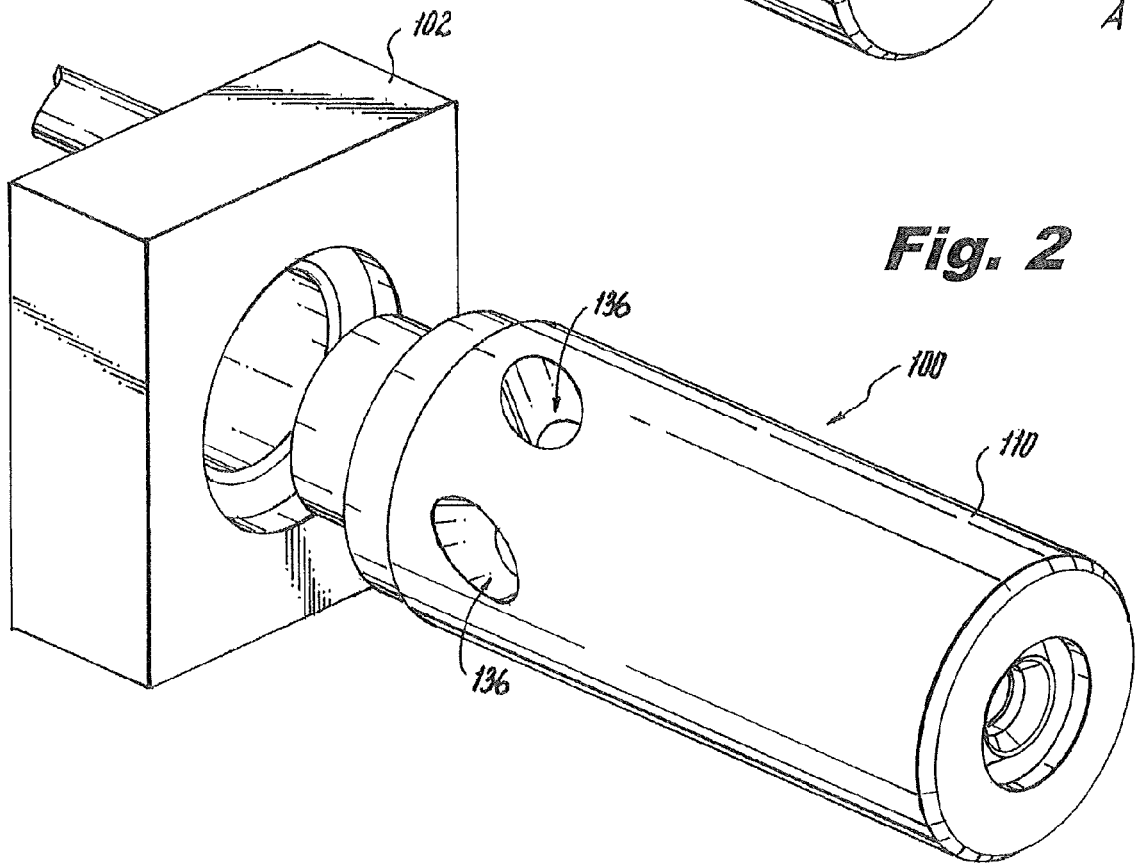
FIG. 2 is a perspective view of the pressure atomizer of FIG. 1, showing the tip assembly of the pressure atomizer removed from the manifold.

Reference will now be made to the drawings wherein like reference numerals identify similar structural features or aspects of the subject invention. For purposes of explanation and illustration, and not limitation, a partial view of an exemplary embodiment of a pressure atomizer in accordance with the invention is shown in FIG. 1 and is designated generally by reference character 100. Other embodiments of pressure atomizers in accordance with the invention, or aspects thereof, are provided in FIGS. 2-11, as will be described. The systems of the invention can be used to produce a wide spray angle for a given atomizer size envelope.

Pressure atomizer 100 is shown in FIG. 1 connected to a fuel manifold 102 which supplies fuel to pressure atomizer 100 for producing an atomized spray of liquid fuel. Pressure atomizer 100 is shown disconnected from manifold 102 in FIG. 2. The connection between pressure atomizer 100 and manifold 102 can be by way of threads, braze, weld or any other suitable method.

Figure 3:
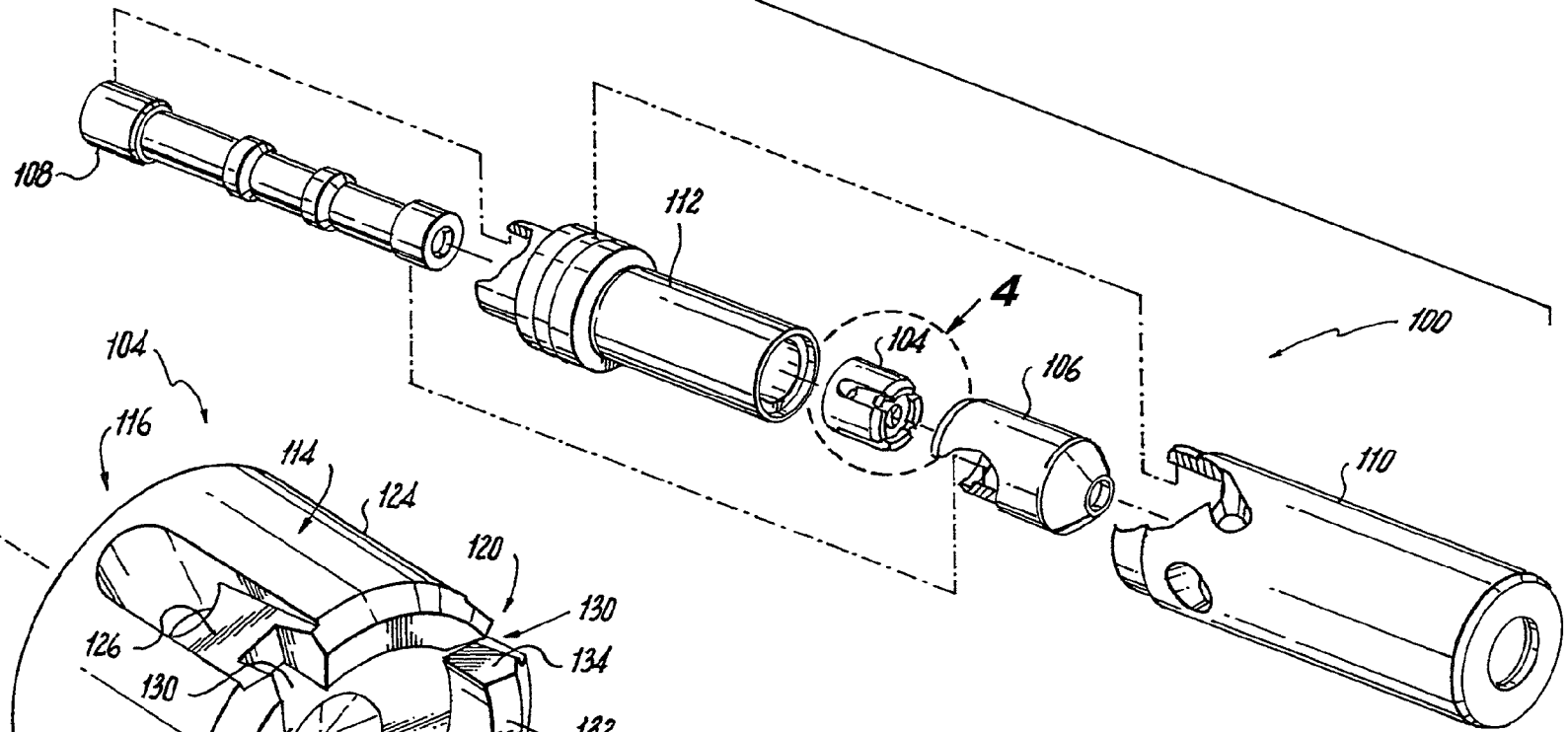
FIG. 3 is an exploded perspective view of the tip assembly of FIG. 1, showing the distributor.

Referring now to FIG. 3, pressure atomizer 100 includes a distributor 104 and a cooperating spray tip 106. Distributor 104 and spray tip 106 are configured and adapted to produce a spray of atomized liquid issuing from the spray tip with a relatively wide spray angle for a given distributor body size. Conduit 108 connects to distributor 104 to supply fuel thereto. Air sleeve 110 forms an outer housing around spray tip 106 and distributor 104. A heat shield 112 is mounted between conduit 108 and air sleeve 110 to provide thermal isolation between fuel flowing through conduit 108 and air flowing through an air circuit between heat shield 112 and air sleeve 110.

Figure 4:
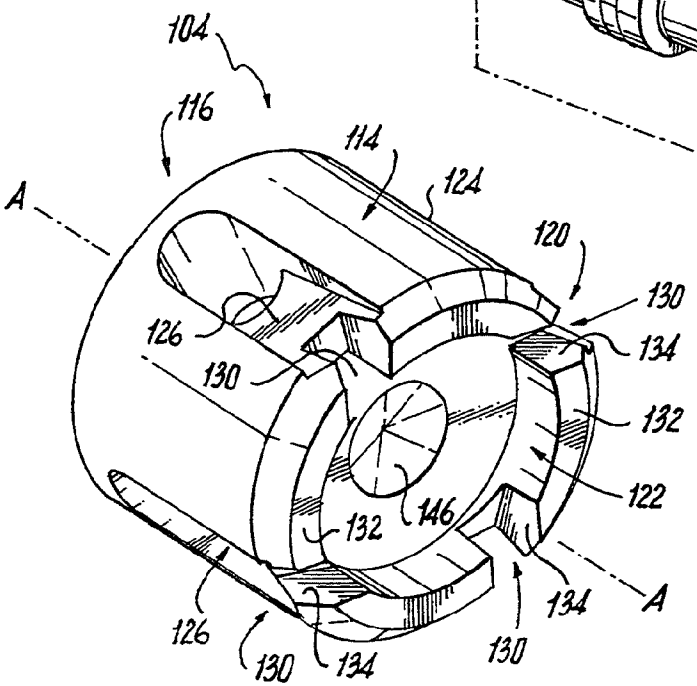
FIG. 4 is a perspective view of the distributor of FIG. 3, showing inclined passages in the outboard peripheral surface.
Figure 5:
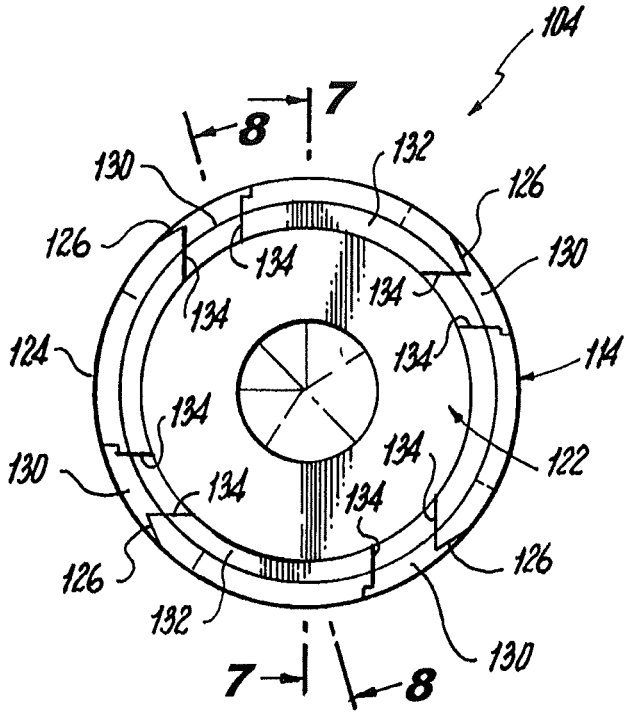
FIG. 5 is an elevation view of the distributor of FIG. 3 as viewed from a position downstream, showing the spin chamber and swirl slots.
Figure 6:
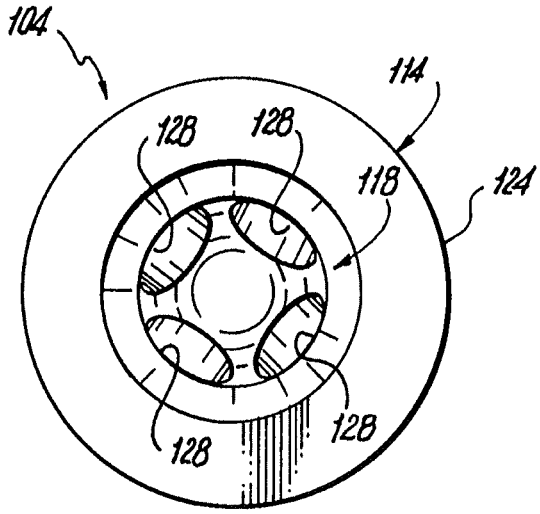
FIG. 6 is an elevation view of the distributor of FIG. 3 as viewed from a position upstream, showing the internal liquid circuit.
Figure 7:
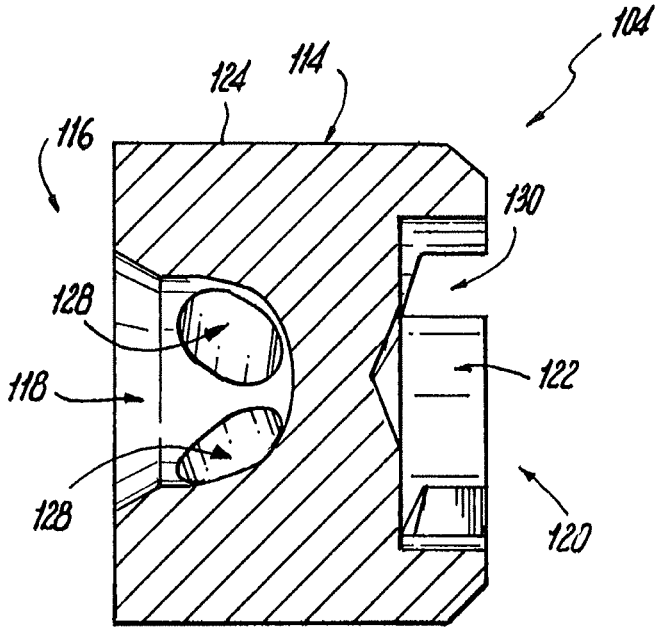
FIG. 7 is a cross-sectional elevation view of the distributor of FIG. 3, as indicated by the section line in FIG. 5, showing the entrances from the internal liquid circuit to two of the communication bores connecting to the respective inclined passages.
Figure 8:
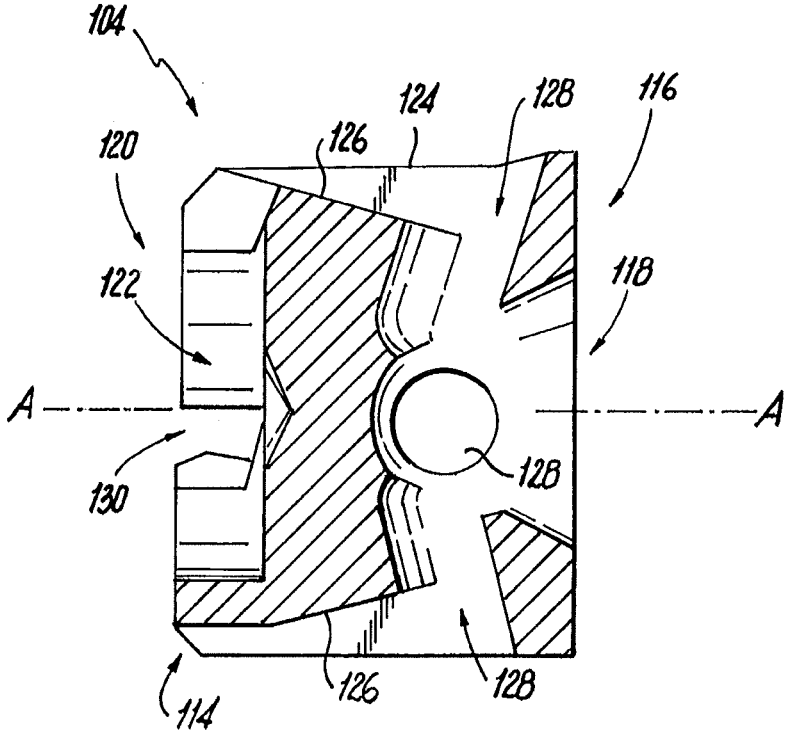
FIG. 8 is a cross-sectional elevation view of the distributor of FIG. 3, as indicated by the section line in FIG. 5, showing two of the communication bores connecting the internal liquid circuit to two respective inclined passages and showing one of the slot walls of one of the swirl slots.

With reference now to FIGS. 4-8, distributor 104 includes a distributor body 114 having an upstream end 116 defining an internal liquid circuit 118, which is shown in FIGS. 6-8. The downstream end 120 defines a spin chamber 122 for swirling liquid flowing therethrough, when assembled together with spray tip 106, the outlet of which is in fluid communication with spin chamber 122 as described in further detail below. An cylindrical outboard peripheral surface 124 extends from upstream end 116 to downstream end 120. Upstream and downstream ends 116, 120 are spaced apart from one another along a longitudinal axis A.

Figure 11:
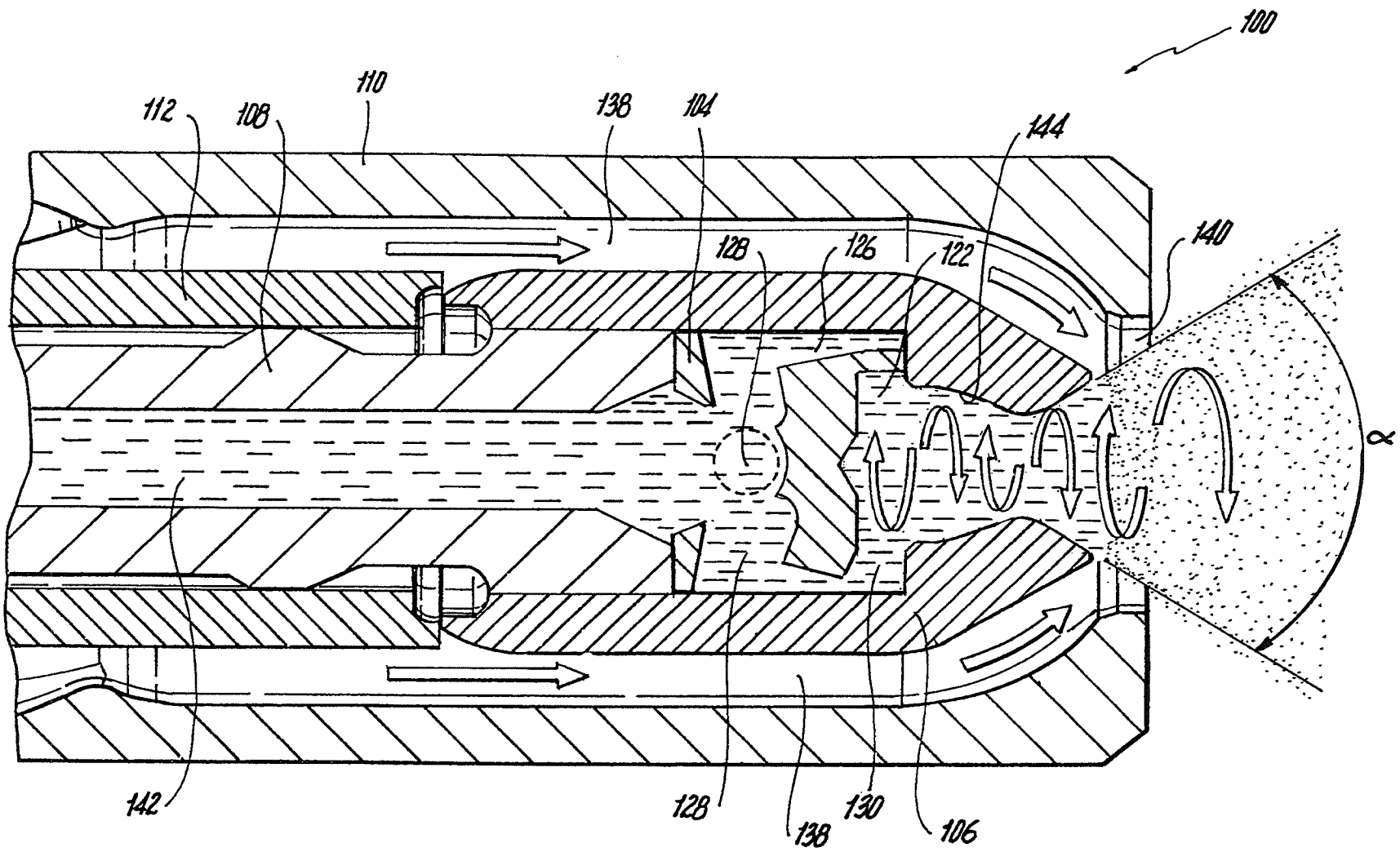
FIG. 11 is a cross-sectional elevation view of the pressure atomizer of FIG. 1, schematically showing the air and liquid flow through the assembly where the cross-section of the fuel distributor corresponds to that in FIG. 8.

Four inclined passages 126, shown in FIGS. 4 and 8, are defined in outboard peripheral surface 124 in fluid communication with internal liquid circuit 118 and with spin chamber 122. Inclined passages 126 are evenly spaced apart from one another circumferentially. The channel floor of each inclined passage 126 is angled to diverge from axis A in a direction toward downstream end 120, and is deeper relative to surface 124 proximate upstream end 116 and shallower proximate downstream end 120. When distributor 104 is assembled into spray tip 106, each inclined passage 126 forms a flow passage with the adjacent inboard wall of the spray tip 106, as shown in FIG. 11, which tapers radially outwards towards the downstream direction to accelerate fluids passing therethrough and to direct liquid to the outer portion of distributor 104, as will be described in further detail below.

With reference to FIGS. 6-8, each inclined passage 126 is in fluid communication with internal liquid circuit 118 by way of a communication bore 128 defined through distributor body 104 from internal liquid circuit 118 to an upstream portion of the respective inclined passage 126. FIGS. 6-8 show the circular openings where bores 128 meet internal liquid circuit 118. As shown in FIG. 8, the communication bores 128 extend in a substantially radial direction relative to axis A, and are angled slightly in the upstream direction to allow for increased length in inclined passages 126 within the given overall length of distributor 104 along axis A.

Referring now to FIGS. 4-5, each inclined passage 126 is in fluid communication with spin chamber 122 by way of a respective swirl slot 130 defined in downstream end 120 of distributor body 104 through an annular rim 132 around spin chamber 122. Each swirl slot 130 includes two opposed slot walls 134 in annular rim 132. The opposed slot walls 134 of each swirl slot 130 define a flow path therethrough that is off-center with respect to annular rim 132 and to axis A. This off-center configuration induces swirl on fluids passing through swirl slots 130 into spin chamber 122. The side walls of each inclined passage 126 are aligned parallel to axis A. However, it is also contemplated that the sidewalls could be angled with respect to axis A, e.g., to impart an element of swirl about axis A to preswirl liquid before passing through swirl slots 130.

Figure 9:
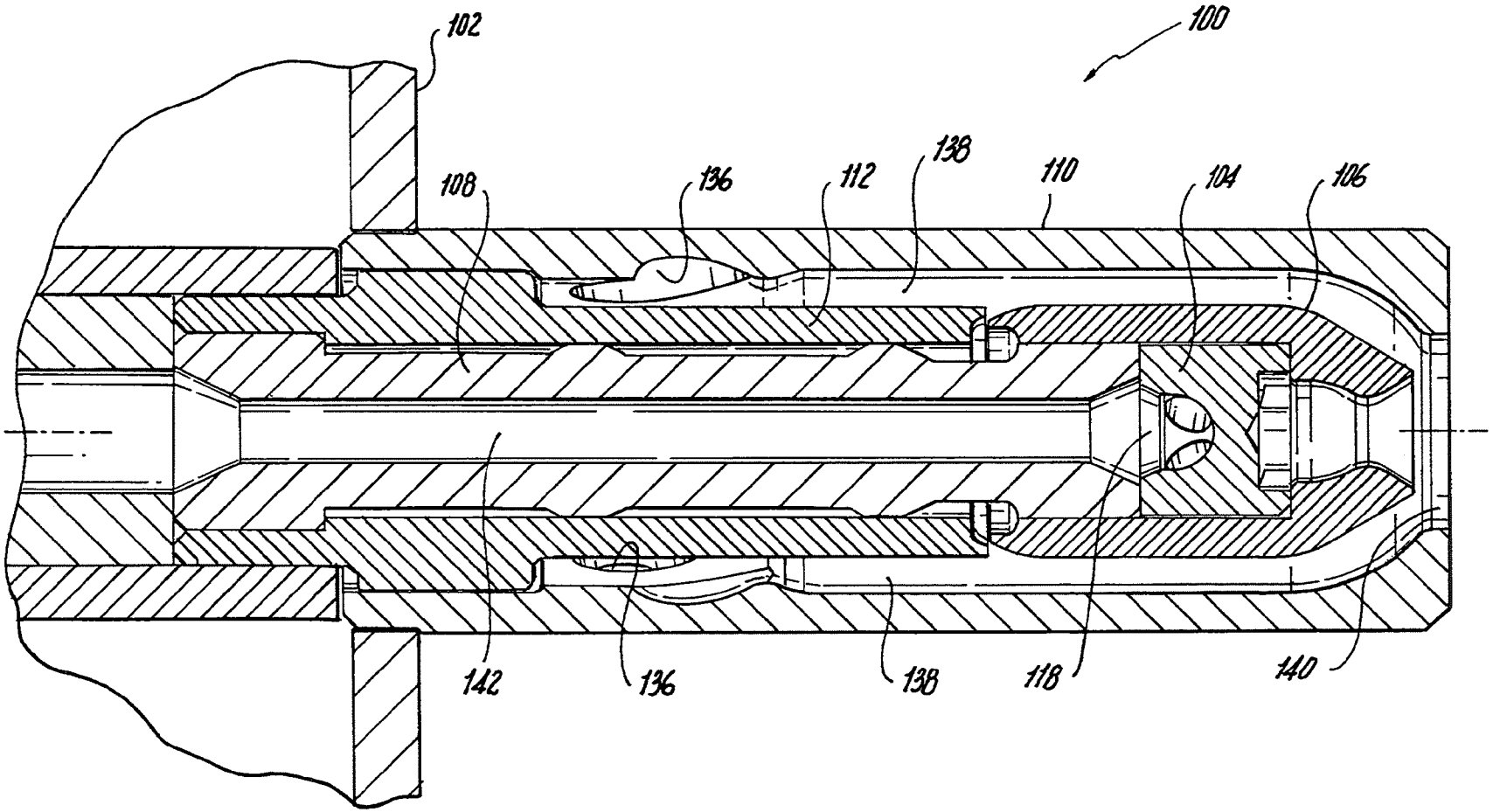
FIG. 9 is a cross-sectional elevation view of the pressure atomizer of FIG. 1, showing the liquid and air circuits.

With reference now to FIG. 9, when pressure atomizer 100 is assembled, air sleeve 110 is mounted radially outboard of the spray tip 106 for delivering a flow of air from an external source, through radial air swirler inlets 136 and air circuit 138 and into proximity with spray tip 106, as further described below. Air circuit 138 is bounded on its inboard extent by heat shield 112 and spray tip 106, and is bounded on its outboard extent by air sleeve 110. Conduit 108 serves as a liquid delivery tube having a fluid delivery passage 142 in fluid communication with internal liquid circuit 118 of distributor 104 for delivering liquid thereto from an external source, such as manifold 102. Heat shield 112 is mounted between conduit 108 and air sleeve 110 for thermal isolation of liquid fuel flowing through the passage 142 from high temperatures in air circuit 138 and outboard of air sleeve 110. This thermal isolation reduces coking of the fuel flowing through atomizer 100.

Figure 10:
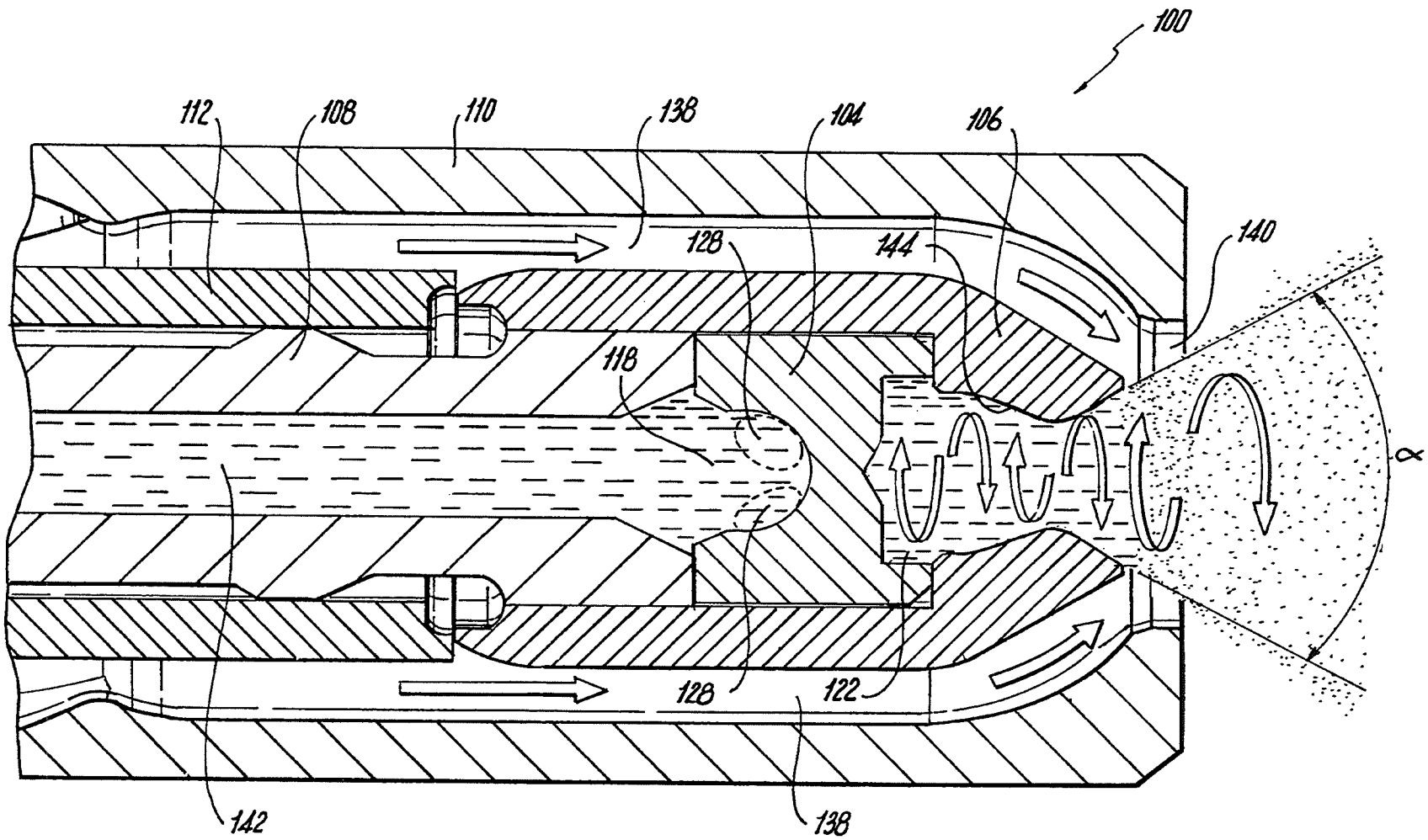
FIG. 10 is a cross-sectional elevation view of the pressure atomizer of FIG. 1, schematically showing the air and liquid flow through the assembly where the cross-section of the distributor corresponds to that in FIG. 7.

The flow of liquid and air through pressure atomizer 100 is described with reference now to FIGS. 10 and 11. Liquid fuel passes from conduit 108 into internal liquid circuit 118 of distributor 104. From there, the fuel flows into bores 128, which are indicated in phantom in FIG. 10, which corresponds to the view of distributor 104 in FIG. 7. FIG. 11, which corresponds to the view of distributor 104 in FIG. 8, shows the fuel communicating through bores 128 into inclined passages 126. As the fuel passes from the inclined passages 126 through swirl slots 130 into spin chamber 122, the radially offset swirl slots 130 swirl the fuel as it enters spin chamber 122. Swirl slots 130 are where the primary pressure drop takes place. The converging, diverging contours of outlet 144 of spray tip 106 accelerate the swirling flow of fuel, which breaks into a diverging, atomized spray of liquid droplets passing together with the air leaving air circuit 138 through outlet 140 of air sleeve 110.

Due to inclined passages 126 pushing fuel clear out to the inner wall of spray tip 106, the full diameter of distributor 104 is utilized and swirl slots 130 are lengthened, effectively enhancing the moment arm for generating swirl through swirl slots 130. This enhanced swirl allows for wide spray angles $\alpha$ and relatively high flow numbers given the size of distributor 104, swirl tip 106, and air sleeve 110. Spray angle is defined as the visual interpretation, e.g., via a protractor, of the included angle formed by two straight lines drawn from the discharge orifice to cut the spray contours at a specific distance from the atomizer face. Flow number is mass flow rate in pounds-per-hour divided by the square-root of the pressure-drop in pounds-per-square-inch.

An exemplary embodiment of this configuration can produce a spray of atomized liquid issuing from the spray tip having a spray angle greater than about 90°, wherein the outboard peripheral surface of the distributor has a diameter less than about 0.125 inches, and wherein the flow number is greater than about 6.0. In another exemplary embodiment, a spray angle greater than about 80° can be attained with a flow number greater than about 4.0 wherein the diameter of the distributor is less than about 0.100 inches. In yet another exemplary embodiment, a spray angle greater than about 75° can be attained with a flow number greater than about 3.0 wherein the diameter of the distributor is less than about 0.080 inches. Generally, flow number can be increased by deepening and/or widening swirl slots 130, and/or increasing the number of inclined passages 126 and/or swirl slots 130.

The enhanced swirl and spray angle in pressure atomizer 100 are accomplished with a much smaller distributor 104 than in traditional pressure atomizers capable of producing comparably wide spray angles. This relatively small size of distributor 104 allows for a relatively small overall size envelope for pressure atomizer 100 even with the inclusion of air sleeve 110 and heat shield 112, which are optional especially in thermally benign applications with particularly small size constraints. Traditional designs have an annular feed passage in the distributor which requires a much larger size envelope to produce a given spray angle.

Distributor 104 and the other components of pressure atomizer 100 can be formed by conventional machining techniques and can be joined together by conventional joining techniques. It is also contemplated that additive machining techniques, or any other suitable techniques capable of holding suitable tolerances, can be used. The dimple 146 in swirl chamber 122, shown in FIG. 4, is optional and is shown as an artifact of an exemplary machining process used for foiling distributor 104. Internal liquid circuit 118 and communication bores 128 can be formed by plunging suitably shaped tools into distributor 104, which can then be followed by end milling inclined passages 126 and swirl slots 130, for example. If conventional machining is used, due to the potentially small size of distributor 104, it can be advantageous to perform as much of the machining of distributor 104 as possible in the end of an elongate work piece rod for ease of handling until the extra rod portion must be removed from distributor 104.

While shown and described above in the exemplary context of fuel injection, those skilled in the art will readily appreciate that pressure atomizers constructed in accordance with the subject invention can be used to atomize fuel, water, or any other suitable liquid. Moreover, while shown in an exemplary application where a pressure atomizer is mounted to a manifold, those skilled in the art will readily appreciate that the systems and methods of the subject invention can readily be used in any other suitable application. Additionally, while shown with an exemplary embodiment having four communication bores, four inclined passages, and four swirl slots, those skilled in the art will readily appreciate that any other suitable number of communication bores, inclined passages, and swirl slots can be used on a distributor without departing from the spirit and scope of the invention.

The methods and systems of the present invention, as described above and shown in the drawings, provide for pressure atomization with superior properties including producing a wide spray angle for a given size envelope. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A distributor for a pressure atomizer comprising:

a) a distributor body having an upstream end defining an internal liquid circuit, a downstream end defining a spin chamber for swirling a liquid flowing therethrough, and an outboard peripheral surface extending from the upstream end to the downstream end, wherein the upstream and downstream ends are spaced apart along a longitudinal axis; and b) an inclined passage defined in the outboard peripheral surface in fluid communication with the internal liquid circuit and with the spin chamber for producing a relatively wide spray angle for a given distributor body size, wherein the inclined passage is angled to diverge from the longitudinal axis of the distributor body in a direction toward the downstream end, wherein the inclined passage is in fluid communication with the spin chamber by way of a swirl slot defined in the downstream end of the distributor body through an annular rim around the spin chamber, and wherein the swirl slot includes opposed slot walls in the annular rim, wherein the opposed slot walls define a flow path therethrough that is off-center with respect to the annular rim to induce swirl on fluids passing therethrough.

2. A distributor as recited in claim 1, wherein the inclined passage is in fluid communication with the internal liquid circuit by way of a communication bore defined through the distributor body from the internal liquid circuit to an upstream portion of the inclined passage.

3. A distributor as recited in claim 2, wherein the communication bore extends in a substantially radial direction.

4. A distributor as recited in claim 1, wherein the outboard peripheral surface is substantially cylindrical.

5. A distributor as recited in claim 1, further comprising at least one additional inclined passage defined in the outboard peripheral surface in fluid communication with the internal liquid circuit and with the spin chamber.

6. A distributor as recited in claim 5, wherein the inclined passages are substantially evenly spaced apart from one another circumferentially.

7. A distributor as recited in claim 5, wherein each inclined passage is in fluid communication with the spin chamber by way of a respective swirl slot defined in the downstream end of the distributor body through an annular rim around the spin chamber, and wherein each swirl slot includes opposed slot walls in the annular rim, wherein the opposed slot walls define a flow path therethrough that is off-center with respect to the annular rim to induce swirl on fluids passing therethrough.

8. A distributor for a pressure atomizer comprising:

a) a distributor body having an upstream end defining an internal liquid circuit, a downstream end defining a spin chamber for swirling a liquid flowing therethrough, and an outboard peripheral surface extending from the upstream end to the downstream end, wherein the upstream and downstream ends are spaced apart along a longitudinal axis; and b) an inclined passage defined in the outboard peripheral surface in fluid communication with the internal liquid circuit and with the spin chamber for producing a relatively wide spray angle for a given distributor body size, wherein the inclined passage is angled to diverge from the longitudinal axis of the distributor body in a direction toward the downstream end, wherein the inclined passage is ramped with respect to the outboard peripheral surface with a deeper portion thereof proximate the upstream end and a shallower portion thereof proximate the downstream end to accelerate fluids flowing therethrough from the upstream end to the downstream end of the distributor body.

9. A distributor as recited in claim 8, wherein the inclined passage is in fluid communication with the internal liquid circuit by way of a communication bore defined through the distributor body from the internal liquid circuit to an upstream portion of the inclined passage.

10. A distributor as recited in claim 9, wherein the communication bore extends in a substantially radial direction.

11. A distributor as recited in claim 8, wherein the outboard peripheral surface is substantially cylindrical.

12. A distributor as recited in claim 8, further comprising at least one additional inclined passage defined in the outboard peripheral surface in fluid communication with the internal liquid circuit and with the spin chamber.

13. A distributor as recited in claim 12, wherein the inclined passages are substantially evenly spaced apart from one another circumferentially.

14. A distributor as recited in claim 12, wherein each inclined passage is in fluid communication with the spin chamber by way of a respective swirl slot defined in the downstream end of the distributor body through an annular rim around the spin chamber, and wherein each swirl slot includes opposed slot walls in the annular rim, wherein the opposed slot walls define a flow path therethrough that is off-center with respect to the annular rim to induce swirl on fluids passing therethrough.

15. A distributor for a pressure atomizer comprising:

a) a distributor body having an upstream end defining an internal liquid circuit, a downstream end defining a spin chamber for swirling a liquid flowing therethrough, and an outboard peripheral surface extending from the upstream end to the downstream end, wherein the upstream and downstream ends are spaced apart along a longitudinal axis; and b) an inclined passage defined in the outboard peripheral surface in fluid communication with the internal liquid circuit and with the spin chamber for producing a relatively wide spray angle for a given distributor body size, wherein the inclined passage is angled to diverge from the longitudinal axis of the distributor body in a direction toward the downstream end, further comprising at least one additional inclined passage defined in the outboard peripheral surface in fluid communication with the internal liquid circuit and with the spin chamber, wherein each inclined passage is in fluid communication with the internal liquid circuit by way of a respective communication bore defined through the distributor body from the internal liquid circuit to an upstream portion of the inclined passage, and wherein each communication bore extends in a substantially radial direction.

16. A distributor as recited in claim 15, wherein the outboard peripheral surface is substantially cylindrical.

17. A distributor as recited in claim 15, wherein the inclined passages are substantially evenly spaced apart from one another circumferentially.

18. A distributor as recited in claim 15, wherein each inclined passage is in fluid communication with the spin chamber by way of a respective swirl slot defined in the downstream end of the distributor body through an annular rim around the spin chamber, and wherein each swirl slot includes opposed slot walls in the annular rim, wherein the opposed slot walls define a flow path therethrough that is off-center with respect to the annular rim to induce swirl on fluids passing therethrough.

* * * * *